US006634414B2

(12) United States Patent
Miller

(10) Patent No.: US 6,634,414 B2
(45) Date of Patent: Oct. 21, 2003

(54) PRESSURE DIE CASTING MACHINE

(75) Inventor: Josef Miller, Winterbach (DE)

(73) Assignee: Oskar Frech GmbH & Co., Schorndorf (DE)

( * ) Notice: Subject to any disclaimer, the term of this patent is extended or adjusted under 35 U.S.C. 154(b) by 0 days.

(21) Appl. No.: 10/163,337

(22) Filed: Jun. 7, 2002

(65) Prior Publication Data

US 2002/0185246 A1 Dec. 12, 2002

(30) Foreign Application Priority Data

Jun. 9, 2001 (EP) ..... 01114113

(51) Int. Cl.[7] ..... B22D 17/10
(52) U.S. Cl. ..... 164/312; 164/341
(58) Field of Search ..... 164/312, 313, 164/314, 315, 316, 317, 318, 113, 341

(56) References Cited

U.S. PATENT DOCUMENTS

| | | | | |
|---|---|---|---|---|
| 3,701,377 A | * | 10/1972 | Fisher | 164/113 |
| 4,566,522 A | | 1/1986 | Fink et al. | 164/316 |
| 6,321,826 B1 | * | 11/2001 | Fink et al. | 164/316 |

FOREIGN PATENT DOCUMENTS

| | | |
|---|---|---|
| DE | 30 18 288 | 5/1982 |
| DE | 34 23 056 | 1/1986 |
| JP | 200158500 | 6/2000 |

* cited by examiner

*Primary Examiner*—Kuang Y. Lin
(74) *Attorney, Agent, or Firm*—Crowell & Moring LLP

(57) ABSTRACT

A pressure die casting machine is provided for processing fused metals in which the die locking unit is mounted adjustably on a lifting frame that can be vertically raised or lowered to adapt the die locking unit to the casting nozzle via lever sets and a common mechanical adjusting device for these lever sets. This arrangement achieves a space-saving arrangement with a simplified design.

22 Claims, 1 Drawing Sheet

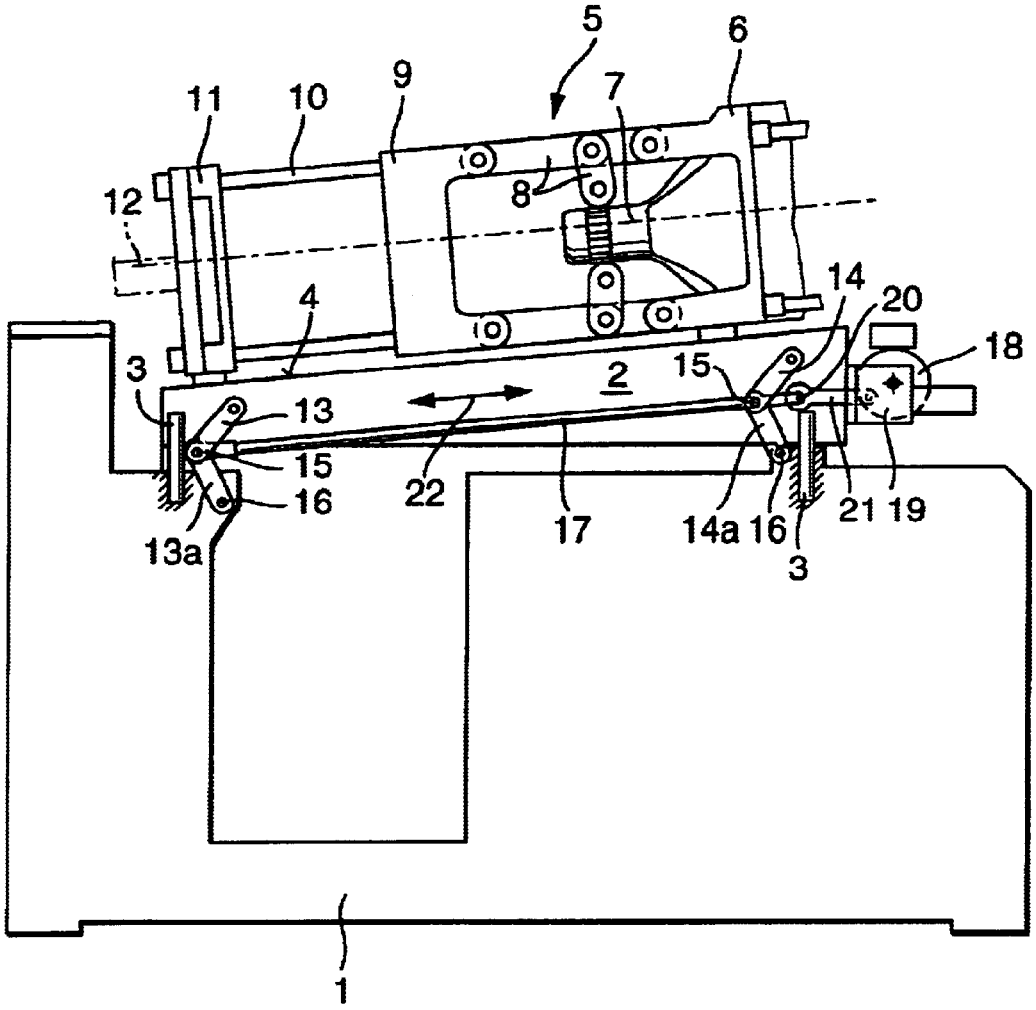
5
6
11
10
9
7
8
12
4
14
20
18
3
2
15
13
15
16
22
17
14a
16
21
19
13a
3
1

PRESSURE DIE CASTING MACHINE

BACKGROUND AND SUMMARY OF THE INVENTION

This application claims the priority of European Application No. 01114113.2 filed Jun. 9, 2001, the disclosure of which is expressly incorporated by reference herein.

The invention relates to a pressure die casting machine for processing fused metals that has a machine tool table having arranged on it a casting nozzle and a die locking unit that can be aligned with the nozzle and is comprised of a crosshead, a stationary die platen and a die platen that is mounted on a guide pillar and can be moved to press against the stationary one and is mounted with a high degree of adjustability on an inclined guide surface that is supported on the machine tool table.

A pressure die casting machine of this type is known from German Patent 30 18 288 A1 (corresponds to U.S. Pat. No. 4,566,522). In that case, the die locking unit is mounted on guide rails that are inclined in relation to the horizontal guide rails. Since different gate positions are provided on the die, depending on the type of die to be used, it is necessary to adjust the height of the locking part. With hot-chamber pressure die casting machines, the casting nozzle, because the casting container always remains in the molten mass, is generally known to stay in a particular position, so that the gating part of the die must be adapted to this casting nozzle.

To adjust height in this case, levers, which are mounted crosswise in relation to each other and form a scissors mechanism that engages beneath the locking unit on the bottom of the crosshead and the movable die platen and can be spread from each other via a drive mechanism, are provided in the known hot-chamber pressure die casting machine. Such a configuration takes up a relatively large amount of space beneath the locking unit. Depending on the die locking part position and the load distribution required as a result, even an exact synchronous running is not always ensured with a design of this type.

Known from German Patent 34 23 056 C2 is a height adjustment device for the die locking unit of a hot-chamber pressure die casting machine in which one pressure cylinder has been assigned to the crosshead and a second pressure cylinder arrangement has been provided on the stationary die platen and the two pressure cylinders are each propped against the machine tool table. Due to the joint pressure medium action for the two pressure cylinder mechanisms, the die locking unit can also be adjusted in height. However, this design is relatively expensive because the pressure means circuit must be controlled exactly via appropriate relay valves.

An object of the present invention is therefore to develop a hot-chamber pressure die casting machine of the type mentioned at the beginning such that a simple height adjustment attainable with mechanical elements alone becomes possible, which has a simple and space-saving design.

This objective is achieved with a pressure die casting machine of the type mentioned at the beginning by providing that the inclined guide surface part provided there is part of a lifting frame that is mounted in a vertically adjustable way on the machine tool table. This configuration now makes it possible in a simple manner to move the entire lifting frame in parallel and vertical senses. In a further development of certain preferred embodiments of the invention it is facilitated in an especially simple manner for the lifting frame to be adjustable using at least two pairs of levers that are arranged in the manner of a parallelogram which can be swiveled in the same direction. Thus, one lever pair each can be assigned to the lifting frame approximately in the areas of the two ends of the lifting frame so that, if a common drive mechanism is provided for the lever pair, an exactly parallel raising of the lifting frame is achieved.

In this context, in a further development of certain preferred embodiments of the invention, a mechanical connection between the lever pair having a drive mechanism acting in the direction of the connection can be provided in a very simple manner as a common drive mechanism. In a simple configuration, the lever pairs can be designed as two lever sets connected by a joint to an elbow lever pair, of which one lever is pivot-mounted on the lifting frame and the other is mounted on the machine tool table. The common drive mechanism in this case engages in the connection joint of both levers. A connecting rod or even a gear rack can be provided in a simple manner as a common drive mechanism, whereby an electric motor with a gearbox, for example, can be used as the drive mechanism. Obviously, a hydraulic motor, a hydraulic cylinder or a pneumatic bellows-type cylinder can also be provided as the drive mechanism. Even a hand crank, a linear motor or an eccentric crank drive or a so-called pneumatic muscle can be provided as a drive mechanism. In any case, a mechanical element, thus for example a connecting rod, is pushed by the drive mechanism, which then actuates the two elbow lever pairs jointly so that an exact synchronous operation to raise the lifting frame, and with it the die locking unit, is ensured. Complicated controllers are not necessary. Since this lever drive can be integrated in the lifting frame, no additional space is needed for the arrangement of a separate lifting device.

The precondition for these mechanically effected vertical lifting movement is vertical guides for the lifting frame, which can be designed, for example, as stationary vertically running pins or rails on the machine tool table that engage in guides of the lifting frame or vice-versa.

Guide pins or rails project from the lifting frame and are conducted into corresponding vertical guides of the machine tool table.

The invention is illustrated on the basis of an embodiment and explained below.

Other objects, advantages and novel features of the present invention will become apparent from the following detailed description of the invention when considered in conjunction with the accompanying drawings.

BRIEF DESCRIPTION OF THE DRAWINGS

The single drawing FIGURE is a side schematic view of a machine tool table and lifting frame of a hot-chamber die casting machine, constructed according to a preferred embodiment of the invention.

DETAILED DESCRIPTION OF THE DRAWINGS

The single FIGURE in this case shows a hot-chamber pressure die casting machine that has a machine tool table 1 on which a lifting frame 2 is arranged with vertical adjustability so that guide pins 3 projecting vertically from machine tool table 1 engage in longitudinal guides of the lifting frame. An alternate contemplated embodiment would have the vertical guide arranged in the reverse sense when the pins project from lifting frame 2 and engage in guides of the machine tool table. The lifting frame is inclined at an angle less than 5° in relation to the horizontal plane so that it has a top guide surface 4 that likewise runs at an angle to the horizontal plane.

Provided on this guide surface 4 is a locking unit 5 that is constructed of a crosshead 6, assigned to this a drive cylinder 7 for an elbow lever mechanism 8 and connected in turn to this a movable die platen or clamping plate 9. The movable die clamping plate 9 is slide-mounted on guide pillars 10 and interacts with a stationary die clamping plate 11 that is driven in the indicated direction against a stop and therefore is held in a specific position in relation to a casting nozzle 12 indicated by dot-dash lines. Casting nozzle 12 is connected to a casting tank container (not shown) that immerses fused metals kept liquid inside a traveling pot. This casting container is equipped with a casting plunger apparatus by which the cast is pressed to casting nozzle 12 and thus into the die (not shown in the exemplary embodiment) held between stationary die clamping plate 11 and movable die clamping plate 9.

The FIGURE shows that lifting frame 2 in the area of each of its two ends is provided with levers 13 and 14, which are each connected via a connection joint 15 to a second equally long lever 13*a* or 14*a*, respectively. Levers 13 and 14 in this context form a parallelogram crank mechanism and are swivel mounted on lifting frame 2; levers 13*a* and 14*a* are each swivel-mounted at hinge point 16 on machine tool table 1. Levers 13, 13*a*, 14 and 14*a* thereby form a type of elbow joint. The two articulated joints 15 in turn have a connection joint connection with a connecting rod 17 of a spindle lift mechanism, the longitudinal drive of connecting rod 17 being accomplished via an electric motor 18 and a gearbox 19, which converts the rotary movement of electric motor 18 into the longitudinal movement of connecting rod 17 via a gear rack, for example. Connecting rod 17 in this case is connected via a clutch coupling 20 to driven part 21 of gearbox 19.

As becomes clear without further elaboration, a raising or lowering of lifting frame 2, which still has only a vertical degree of freedom due to its guides 3, can be achieved by moving connecting rod 17 in the direction of arrow 22. The lifting frame is vertically raised with precision. This makes it possible to adapt the die held between stationary die clamping plate 11 and movable die clamping plate 9 to the casting nozzle 12 in a simple manner.

As the FIGURE shows, the lifting drive mechanism, i.e., the set of levers 13, 14, 13*a*, 14*a* can also be incorporated into lifting frame 2, if it is provided with suitable hollow spaces. This leads to a protected execution of the lifting drive and to a very space-saving configuration.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Pressure die casting machine for processing fused metals that has a machine tool table with a casting nozzle and a die locking unit that can be aligned with it and is comprised of a crosshead, a stationary die clamping plate and a movable die clamping plate mounted on guide columns, which moveable die clamping plate can be pressed against the stationary clamping plate, and which die locking unit is mounted with height adjustability on a guide surface part propped against the machine tool table, wherein the guide surface is a part of a lifting frame which is mounted with vertical mobility on the machine tool table.

2. Pressure die casting machine according to claim 1, wherein the lifting frame can be adjusted in height via at least two lever pairs connected to the lifting frame and the machine tool table, arranged in a manner of a parallelogram, which can swivel in a same direction.

3. Pressure die casting machine according to claim 2, wherein the lever pairs are adjustable via a common drive.

4. Pressure die casting machine according to claim 3, wherein a mechanical connection to the lever pairs is provided with a drive mechanism that acts in a direction of the connection.

5. Pressure die casting machine according to claim 2, wherein the lever pairs are each configured as two lever sets connected via a connecting joint as elbow lever pairs, of which one lever is swivel-mounted on the lifting frame and the other is swivel-mounted on the machine tool table, and the common drive mechanism engages in respective articulated joints of both sets of levers.

6. Pressure die casting machine according to claim 3, wherein a gear rack is provided as a common drive mechanism.

7. Pressure die casting machine according to claim 5, wherein a gear rack is provided as a common drive mechanism.

8. Pressure die casting machine according to claim 3, wherein a connecting rod is provided as a common drive mechanism.

9. Pressure die casting machine according to claim 5, wherein a connecting rod is provided as a common drive mechanism.

10. Pressure die casting machine according to claim 6, wherein an electric motor with a gearbox is provided as a drive mechanism.

11. Pressure die casting machine according to claim 8, wherein an electric motor with a gearbox is provided as a drive mechanism.

12. Pressure die casting machine according to claim 1, wherein the lifting frame is held on vertical guides.

13. Pressure die casting machine according to claim 12, wherein the vertical guides are configured as pins or rails that are fixedly arranged on the lifting frame or on the machine tool table and engage, respectively, in guides of the machine tool table or the lifting frame.

14. Pressure die casting machine assembly comprising:

a machine tool table, a die locking unit including a pair of relatively movable die clamping plates, and die locking unit support means movable vertically by a vertical lifting means and operable to accommodate vertical adjustment of said die locking unit with respect to said machine tool table.

15. Pressure die casting machine assembly according to claim 14, comprising a lifting frame disposed under the die locking unit, said die locking unit support means being operable to accommodate vertical adjustment of the lifting frame.

16. Pressure die casting machine assembly according to claim 15, wherein said die locking unit support means includes at least two lever pairs arranged in a parallelogram manner.

17. Pressure die casting machine assembly according to claim 16, comprising a common drive for adjustably driving the lever pairs to lift and lower the lifting frames.

18. Pressure die casting machine according to claim 15, comprising vertical guide means operable to guide vertical movement of the lifting frame with respect to the machine tool table.

19. Pressure die casting machine according to claim 18, wherein said vertical guide means are configured as pins or rails fixed to one of the lifting frame and machine tool table and guide passages for the pins or rails at the other of the lifting frame and machine tool table.

20. Pressure die casting machine according to claim 16, comprising vertical guide means operable to guide vertical movement of the lifting frame with respect to the machine tool table.

21. Pressure die casting machine according to claim 20, wherein said vertical guide means are configured as pins or rails fixed to one of the lifting frame and machine tool table and guide passages for the pins or rails at the other of the lifting frame and machine tool table.

22. Pressure die casting machine according to claim 21, comprising a common drive for adjustably driving the lever pairs to lift and lower the lifting frames.

* * * * *